US005864318A

United States Patent [19]

Cosenza et al.

[11] Patent Number: 5,864,318

[45] Date of Patent: Jan. 26, 1999

[54] COMPOSITE ANTENNA FOR CELLULAR AND GPS COMMUNICATIONS

[75] Inventors: John Cosenza, St. James; Michael Kane, Ridge; William Rovinsky, Old Bethpage; Richard Hines, Stony Brook, all of N.Y.

[73] Assignee: Dorne & Margolin, Inc., Bohemia, N.Y.

[21] Appl. No.: 847,575

[22] Filed: Apr. 24, 1997

Related U.S. Application Data

[60] Provisional application No. 60/016,327 Apr. 26, 1996.

[51] Int. Cl.[6] ..... H01Q 1/32; H01Q 1/38

[52] U.S. Cl. ..... 343/700 MS; 343/830; 343/846

[58] Field of Search ..... 343/700 MS, 830, 343/846

[56] References Cited

U.S. PATENT DOCUMENTS

| | | | |
|---|---|---|---|
| 2,996,713 | 8/1961 | Boyer | 343/700 MS |
| 4,366,484 | 12/1982 | Weiss et al. | 343/700 MS |
| 4,369,447 | 1/1983 | Edney | 343/700 MS |
| 4,410,891 | 10/1983 | Schaubert et al. | 343/700 MS |
| 4,682,180 | 7/1987 | Gans | 343/769 |
| 4,994,820 | 2/1991 | Suzuki et al. | 343/700 MS |
| 5,041,838 | 8/1991 | Liimatainen | 343/700 MS |
| 5,061,939 | 10/1991 | Nakase | 343/700 MS |
| 5,073,761 | 12/1991 | Waterman et al. | 333/24 C |
| 5,099,249 | 3/1992 | Seavey | 343/700 MS |
| 5,121,127 | 6/1992 | Toriyama | 343/700 MS |
| 5,220,334 | 6/1993 | Raguenet et al. | 343/700 MS |
| 5,291,210 | 3/1994 | Nakase | 343/700 MS |
| 5,519,406 | 5/1996 | Tsukamoto et al. | 343/700 MS |

OTHER PUBLICATIONS

Schaubert, Jones and Reggia, Conformal Dielectric–Filled Edge–Slot Antennas with Inductive–Post Tuning, IEEE Transactions on Antennas and Propagation, vol. AP–27, No. 5, Sep. 1979.

*Primary Examiner*—Frank G. Font
*Assistant Examiner*—Roy M. Punnoose
*Attorney, Agent, or Firm*—Hoffmann & Baron, LLP

[57] ABSTRACT

A composite antenna comprising a first and second antenna suitable for transceiving independent signals in the cellular communication and GPS bands. The first antenna has upper and lower electrically conductive discs of substantially the same size aligned substantially in parallel, a first means for application of a first electrical signal between and at substantially geometric centers of the discs, and a plurality of electrically conductive shunts. The second (GPS) antenna is attached atop the upper electrically conductive disc and has a second means for application of a second electrical signal to the GPS antenna which traverses the electrically conductive discs whereby there is no significant degradation in performance of either the first cellular antenna or the second GPS antenna. The shunts are electrically connected to the first electrically conductive disc and the second electrically conductive disc, whereby the first and second electrically conductive discs are spaced from each other by a volume of free space or a volume occupied by a dielectric material. Also described is an antenna for cellular communications alone, with first and second electrically conductive discs spaced from each other by a volume of free space or a volume occupied by a dielectric material, without the second GPS antenna.

44 Claims, 6 Drawing Sheets

COMPOSITE ANTENNA FOR CELLULAR AND GPS COMMUNICATIONS

CROSS-REFERNCE TO RELATED APPLICATION

This application is based on and claims the priority of provisional patent application filed in the United States Patent and Trademark Office on Apr. 26, 1996 and assigned Ser. No. 60/016,327.

TECHNICAL FIELD

This invention relates to antennas, and in particular to a low profile antenna having an omnidirectional radiation pattern which may be easily and removably mounted on the surface of a vehicle for use in cellular telephone, wireless communications while permitting access to Global Positioning System (GPS) resources.

BACKGROUND ART

Antennas with omnidirectional radiation patterns are desired in radio frequency communications systems such as cellular telephones used in automobiles and the like. Typically, vehicle-mounted antennas for cellular communications consist of a short wire or "whip" antenna extending approximately 3.048 meters from the vehicle. this type of cellular antenna is undesirable for a variety of reasons including a greater risk of breakage and interference with other structures around the vehicle (e.g. dynamic mechanisms within a car wash).

Attempts have been made in the prior art to implement cellular telephone antennas utilizing a surface mounted antenna with a low profile. For example, U.S. Pat. No. 5,041,838 describes a planar antenna employing a dielectric substrate with conductive coatings on two major surfaces, one surface is connected to an outer ground shield of a coaxial cable and the other surface is connected to an inner conductor. A plurality of electrically conductive shunts are disposed along a radius of the antenna and interconnect the two major surfaces. Another shunt, not on the same radial line as the plurality of shunts, is also disposed to interconnect the two major surfaces and to match the electrical characteristics of the resulting antenna to those of the transceiver. The location and number of the shunts are experimentally varied in order to adjust the antenna's impedance to resonate within the desired frequency band.

In addition many of the wireless and cellular applications discussed above exhibit simultaneous requirements for GPS resources. Examples of such applications may be in determining transportational logistics and vehicle tracking. For instance, it is often the case that a motorist is stranded on a roadway without specific knowledge of his or her actual location or of how to direct a third party who wishes to locate the stranded motorist. By combining a cellular antenna with access to GPS resources the stranded motorist could simply depress a button linked with the cellular phone which would result in a signal being sent over the cellular band indicating the precise location of the stranded vehicle to a cellular base station as determined using the associated GPS resources. Such a system also becomes useful in military applications where the tracking of military vehicles in order to yield a set of precise, real time coordinates of each of a number of various vehicles is particularly useful when strategic positioning must be dynamic. Currently, as evidenced by the prior art, existing cellular and GPS antennas represent distinct physical structures mounted individually and in different locations on the vehicle. However, due to functional as well as aesthetic considerations, it is desirable to be able to eliminate the dual mounting of two separate units for GPS and cellular communication by having a single module for accomplishing both functions.

It is an object of the present invention to combine a low profile antenna having an omnidirectional radiation pattern for use in microwave communications systems such as cellular telephone systems with a GPS antenna in the same compact physical structure whereby the performance of both the low profile antenna and the GPS antenna and preamplifier will not be degraded by interference between the two antennas.

It is a further object of the present invention to provide a low profile antenna having an omnidirectional radiation pattern for use in microwave communications systems such as cellular telephone systems.

DISCLOSURE OF THE INVENTION

Accordingly, in a first embodiment of the present invention, a composite antenna is provided comprising a first antenna for cellular communications and a second antenna for GPS communications atop the first antenna. The first antenna comprises an upper electrically conductive disc, a lower electrically conductive disc of substantially the same size as the upper electrically conductive disc and aligned substantially in parallel therewith, a first means for application of a first electrical signal at substantially the geometric center of the upper electrically conductive disc, and a plurality of electrically conductive shunts. Each of the shunts is electrically connected at a first end thereof to the upper electrically conductive disc, and at a second end thereof to the lower electrically conductive disc , whereby the lower electrically conductive disc and the upper electrically conductive disc are spaced from each other by a volume of free space. The second antenna which has associated therewith a second means for application of a second electrical signal to the second antenna which traverses the electrically conductive discs via an inductor of substantially greater impedance, as detected within the cellular communications bandwidth, than that of the electrically conductive shunts and electrically connected in parallel with the electrically conductive shunts The second means for application of the second electrical signal to the GPS antenna causes no significant interference with and no significant degradation in performance of the first antenna due to the fact that its impedance is substantially greater due to its length and composition within the cellular communications bandwidth, than that of the electrically conductive shunts which are connected electrically in parallel with the second means. The first electrical signal application means comprises a coaxial cable which comprises an inner conductor connected to a substantially geometric center of the upper electrically conductive disc and an outer conductive shield connected to a substantially geometric center or other convenient location on the lower electrically conductive disc.

In further accordance with the first embodiment of the present invention each of the plurality of electrically conductive shunts are integral with one of the electrically conductive discs and comprise a distal end extending perpendicularly therefrom, and the other electrically conductive disc comprises a receiving hole associated with each of the plurality of electrically conductive shunts and adapted to receive therein the distal end of the shunt, wherein each of the distal ends of the electrically conductive shunts mechanically and electrically interconnects with that portion of the electrically conductive disc surrounding each of the associated receiving holes when the electrically conductive discs are brought into mating relationship therewith, whereby structural integrity of the first antenna is attained. The interconnection of the electrically conductive discs may be brought about by other means, including but not limited to soldering and spot welding, so long as structural integrity and electrical connectivity is maintained.

Since the impedance of the first antenna is directly related to the width of the electrically conductive shunts, the width of the electrically conductive shunts may be adjusted in order to tune the first antenna to a desired resonant frequency. However, the width of the electrically conductive shunts may be limited to being greater than the diameter of a coaxial cable if the second antenna mounted atop the upper electrically conductive disc is to be fed via a coaxial cable routed along the length of one of the electrically conductive shunts.

The upper electrically conductive disc may provide a convenient and effective ground for the second antenna by reducing multipath reflections and ripples in the radiation pattern of the second antenna if the second antenna is grounded to the upper electrically conductive disc. Also the upper electrically conductive disc may provide a better ground for the second antenna if it is mounted in close proximity with the second antenna.

Preferably, there are three shunts located around the approximate perimeter of the lower electrically conductive disc, the shunts being spaced equidistant from each other approximately 120 degrees apart. In addition to providing the required impedance between the electrically conductive discs, the shunts are arranged in number and location to provide mechanical integrity and support to the first antenna. By utilizing free space as a medium between the electrically conductive discs, the height of the first antenna may be reduced so that, when three shunts are used for spacing and stability, the diameter of the electrically conductive discs may be as small as three-tenths of one wavelength of the excitation signal and the distance between the electrically conductive discs may be as small as six-hundredths of one wavelength of the excitation signal.

In a second embodiment of the present invention, the composite antenna also comprises a first antenna for cellular communications and a second antenna for GPS communications mounted atop the first antenna. The first antenna comprises a cylindrical substrate of a dielectric material having an upper surface, a lower surface, and a cylindrical side surface disposed therebetween, a first electrically conductive layer disposed on the upper surface of the substrate a second electrically conductive layer disposed on the lower surface of the substrate, a first means for application of a first electrical signal between and at substantially geometric centers of the first and second electrically conductive layers, a plurality of electrically conductive shunts electrically connected to the first and second electrically conductive layers, each of the electrically conductive shunts being located substantially around the perimeter of the substrate (or at other convenient locations). The second antenna also has a second means for application of a second electrical signal to the second antenna which traverses the electrically conductive discs via an inductor of substantially greater impedance than that of the electrically conductive shunts, as detected within the cellular communications bandwidth, and electrically connected substantially in parallel with the electrically conductive shunts is provided which causes no significant interference with and no significant degradation in performance of either the first antenna or the second antenna.

The plurality of electrically conductive shunts may comprise three electrically conductive shunts, each of the electrically conductive shunts spaced substantially 120 degrees from each other. The dielectric material may comprise a plastic. The first and second electrically conductive layers may be formed by electroplating a conductive material on the upper and lower surfaces of the dielectric substrate, wherein each of the electrically conductive shunts comprises a strip of electroplated conductive material disposed on the side surface extending from the first electrically conductive layer to the second electrically conductive layer and electrically interconnecting the first and second electrically conductive layers therewith.

Since the impedance of the first antenna is directly related to the width of the electrically conductive shunts, the width of the electrically conductive shunts may be adjusted in order to tune the first antenna in order to achieve the desired resonant frequency. However, the width of the electrically conductive shunts may be limited to being greater than the diameter of a coaxial cable if the second antenna mounted atop the upper electrically conductive disc is to be fed via a coaxial cable routed along the length of one of the electrically conductive shunts. The upper electrically conductive layer surface may provide a convenient and effective ground for the second antenna by reducing multipath reflections and ripples in the radiation pattern of the second antenna if the second antenna is grounded to the upper electrically conductive layer. Also the upper electrically conductive layer may provide a better ground for the second antenna if it is mounted in close proximity with the second antenna.

In further accord with the second embodiment of the present invention, a recessed slot may extend from the cylindrical side surface to the substantially geometric center of the lower electrically conductive layer, the recessed slot being sufficient to permit a coaxial cable to be disposed therein. The recessed slot provides a convenient area within which the coaxial cable may be placed to enable flush mounting of the antenna. The first application means may comprise a coaxial cable comprising an inner conductor connected to a substantially geometric center of the upper electrically conductive layer and an outer conductive shield connected to a substantially geometric center of the lower electrically conductive layer.

In a third embodiment of the present invention, an antenna for cellular communications is provided which is substantially identical to the first antenna of the first embodiment described above which comprises free space between the electrically conductive discs without the second or GPS antenna. In a fourth embodiment of the present invention, an antenna for cellular communications is provided which is substantially identical to the first antenna of the second embodiment described above which comprises a dielectric filled antenna without the second or GPS antenna.

BRIEF DESCRIPTION OF THE DRAWINGS

These and other objects and features of the invention shall now be described in relation to the drawings.

BEST MODE FOR CARRYING OUT THE INVENTION

Figure 2:
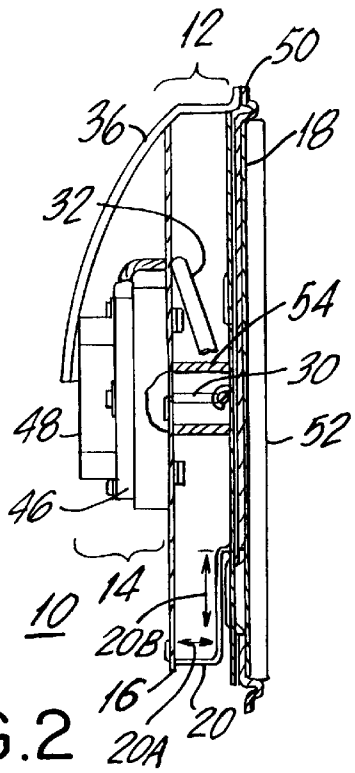
FIG. 2 is a cross-sectional view of the composite antenna of FIG. 1 taken through lines AA and BB.
Figure 1:
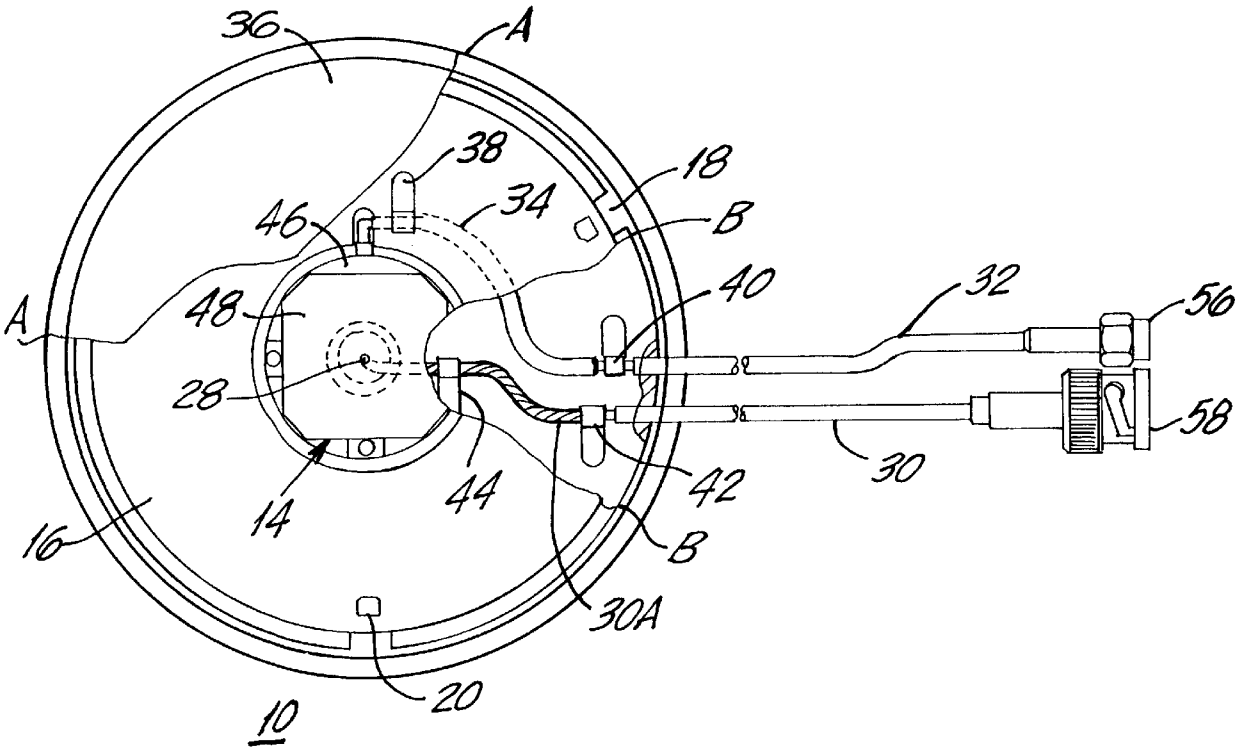
FIG. 1 is a top cross-sectional view of three levels defined by lines AA and BB of a first embodiment of a composite antenna of the present invention.
Figure 3:
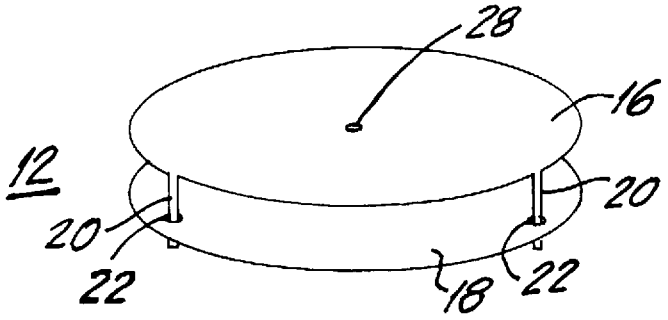
FIG. 3 is a perspective view of a third embodiment of an antenna of the present invention.

FIGS. 1 and 2 illustrate a composite antenna 10 in accordance with a first embodiment of the present invention. The composite antenna 10 is comprised of a combination of a first antenna 12 and a second GPS antenna 14. It is to be understood that the second antenna is not limited only to a GPS antenna but may, for example, instead comprise a high frequency disk antenna having a frequency response of the order of 2.5 Ghz, a monopole whip antenna or other antennas which may be practically mounted atop the first antenna 12. As illustrated in FIG. 3 the first antenna 12 is of a generally circular shape in plan and is designed for application in a cellular communication band and comprises a pair of electrically conductive discs 16 and 18 shown in FIG. 5A and 5B, using an alternative embodiment than that employed in FIGS. 1 and 2.

Figure 2A:
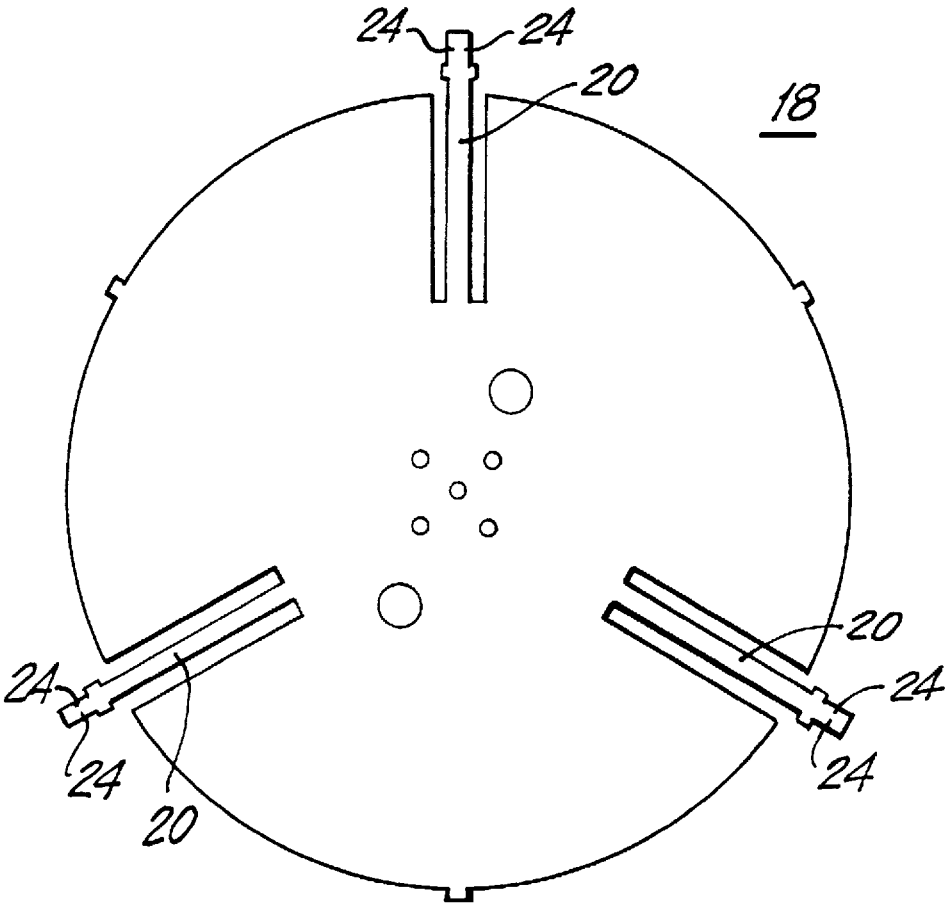
FIG. 2A illustrates an embodiment of a lower electronically conductive disc utilized in the embodiment of the composite antenna illustrated in FIGS. 1 and 2.

FIG. 2A illustrates an embodiment of the lower electrically conductive disc 18 utilized in the composite antenna of FIGS. 1 and 2. The lower electrically conductive disc 18 as shown in FIG. 2A comprises shunt legs 20 which are bent in substantially two places as shown in FIG. 2. A first length 20A of the shunt legs 20 determines the spacing between the electrically conductive discs 16 and 18. A second length 20B of the shunt legs 20 may be designed along with the lower electrically conductive disc 18 to be of different lengths and, thereby, functions to tune the characteristic impedance of the first antenna 12. As the second length 20B of the shunt leg 20 changes the inductance seen looking into the first antenna 12 also changes which enables impedance matching and, therefore, a reduction in transmission losses from potential mismatches between the first antenna and the excitation signal which feeds it. The first and second lengths 20A and 20B of the shunt legs 20 may also be independently adjusted such that the distance between the electrically conductive discs 16 and 18 may be kept the same while altering the length of the second length 20 of the shunt leg 20. In addition, each of the shunt legs 20 may be adjusted in first lengths 20A and/or second lengths 20B independently of any other shunt leg 20.

The diameter of the first antenna 12 is approximately three-tenths of one wavelength of a signal desired to be transmitted and/or received. In particular, the first antenna 12 of the first embodiment is configured to operate at a frequency of 824 to 896 MHz; thus, the diameter of the first antenna 12 is approximately 10.16 cm. Free space yields a permittivity constant of $10^{-9}/36\pi$ F/m whereas typical dielectrics yield substantially higher permittivity constants. One component of impedance is equivalent to the permittivity constant of the dielectric material multiplied by the area of the discs divided by the distance between the discs. Therefore, in order to retain the same impedance and thus frequency response of the antenna as the permittivity constant is increased the distance between the plates must also be increased. In this first embodiment of the present invention, it is desired to implement the first antenna 12 with a volume of free space between the electrically conductive discs 16 and 18. Using free space rather than a dielectric reduces the effective permittivity constant and, as demonstrated by the preceding analysis, this permits the distance between the electrically conductive discs 16 and 18 to be kept to a minimum value. This minimum value has been found to be between three to six-hundredths of the wavelength of the signal desired to be transmitted and/or received. The thickness of the shunt legs 20 also has an effect on impedance as the distance between the discs becomes greater. In this first embodiment, the distance between the electrically conductive discs 16 and 18, is approximately 1.143 cm.

Figure 5A:
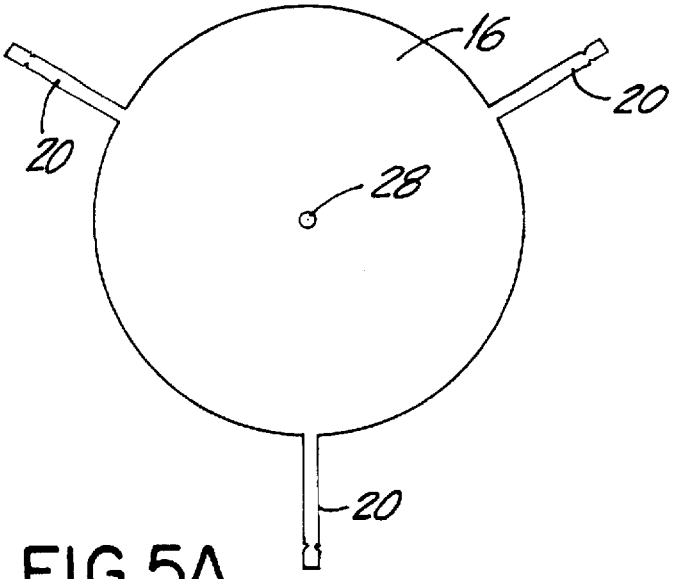
FIGS. 5 and 5A are plan views of the top and bottom electrically conductive discs comprising the antenna shown in FIGS. 1, 2, 3 and 4.
Figure 5:
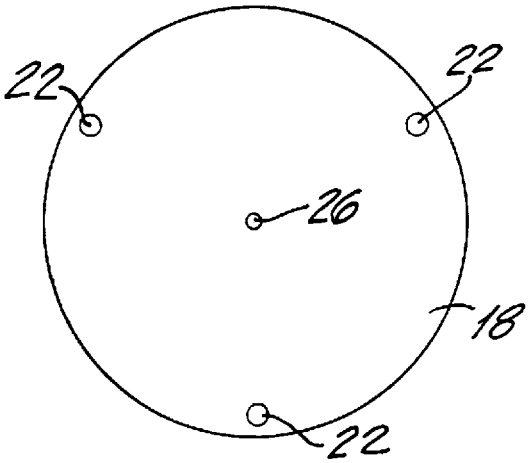
Figure 6:
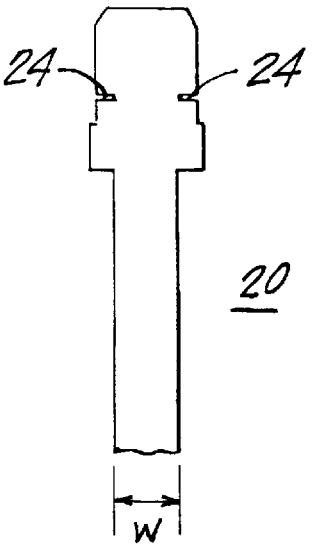
FIG. 6 illustrates a shunt leg of the antenna of FIG. 3.

The electrically conductive discs 16 and 18 are fabricated from a sheet of metal such as brass by stamping processes well known in the art. The upper electrically conductive disc 16 is substantially circular and has three shunt legs 20 attached integral to its perimeter but may be attached at other convenient locations as well as shown by FIG. 2A. Each of the shunt legs 20 are bent such that the shunt legs 20 act as supporting legs capable of mating with associated holes 22 formed in the lower electrically conductive disc 18 as shown in FIGS. 5A and 5B. When the shunt legs 20 are inserted within each of the associated holes 22 and twisted or otherwise caused to make a mechanically stable connection with the lower electrically conductive disc 18, the first antenna 12 is thereby formed. FIG. 6 illustrates the distal ends of each shunt leg 20, which are twisted at recessed portions 24. Alternative methods of connecting the shunt legs 20 are within the scope of the present invention and comprise soldering, spot welding and substantially any other method which provides both a mechanically stable connection as well as electrical connectivity.

Figure 4:
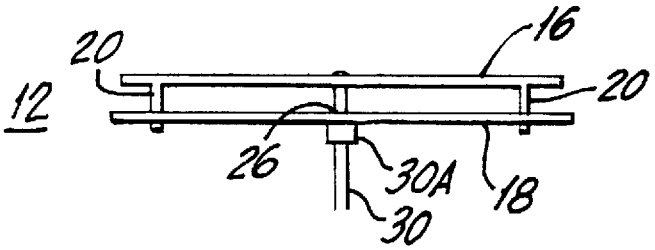
FIG. 4 is a side view of the antenna of FIG. 3.

As shown in FIG. 4, a coaxial cable 30 may be integrated with the first antenna 12 by connecting an outer conductive shield of the coaxial cable 30 to the lower electrically conductive disc 18 and feeding an inner conductor 30A of the coaxial cable 30 through an opening 26 in the lower electrically conductive disc 18 insulated from the disc 18 and connecting the inner conductor 30A of the coaxial cable 30 to the center feed 28 of the upper electrically conductive disc 16. Thus, an excitation signal may be applied or an input signal received via the first antenna 12 and the coaxial cable in a manner well known in the art. Specifically, as a result of this center feed to the first antenna a circular excitation pattern is produced resulting in the standard monopole antenna pattern typically found in mobile cellular communication whip antennas.

In addition to providing electrical connectivity between the electrically conductive discs 16 and 18, the shunt legs 20 provide mechanical stability between the electrically conductive discs 16 and 18, which is particularly important in the first embodiment due to the use of free space in the volume between the electrically conductive discs 16 and 18 as opposed to a solid mass of dielectric material. Since the permittivity of the discs is decreased as the number of shunts is increased it is preferable to use a minimal number of shunts in order to keep the size of the electrically conductive discs 16 and 18 as small as possible (i.e. since larger discs compensate for the reduction in permittivity) for a given operational frequency and corresponding impedance, however, the use of only two shunts would not provide the required structural integrity. Thus, it has been found that three shunts optimizes the structural integrity of the first antenna 12 while keeping the size of the first antenna 12 as small as possible.

Free space yields a permittivity constant of 10−9/36π F/m whereas typical dielectrics yield substantially higher permittivity constants. One component of impedance is equivalent to the permittivity constant of the dielectric material multiplied by the area of the discs divided by the distance between the discs. Therefore, the width W of the shunt legs 20 also has an effect on the distance between the discs since as the shunt legs 20 become thicker the permittivity decreases thereby requiring a greater distance in order to maintain the same impedance.

As shown in FIGS. 1 and 2 the active GPS antenna 14 is fastened on top of the upper electrically conductive disc 18 via means well known in the art. The active GPS antenna 14 is typically equivalent to the GPS antenna used in the DM N91 series GPS antenna which is commercially available through the assignee of this invention, Dorne & Margolin, Inc. 2950 Veterans Memorial Highway, Bohemia, N.Y. 11716 USA, and includes a low noise amplifier. A GPS feed cable 32 is routed through the upper electrically conductive disc 16 and an outer conductive shield of the GPS feed cable 32 is grounded to the upper electrically conductive disc 16 via a first grounding clip 38. The outer conductive shield of the GPS feed cable 32 is also grounded to the lower electrically conductive disc 18 via a second grounding clip 40. The GPS feed cable 32 is electrically connected to a GPS preamp 46 which then feeds a radiating patch element 48 of the GPS antenna 14.

In addition to the method of routing the coaxial cable 30 in order to feed the first antenna 14 described above and illustrated in FIG. 4, the coaxial cable 30 may also be routed as shown in FIGS. 1 and 2. In FIGS. 1 and 2 the coaxial cable 30 is shown grounded to the lower electrically conductive disc 18 via a third grounding clip 42 after which it traverses the lower electrically conductive disc 18 and extends across a gap between the upper electrically conductive disc 16 and the lower electrically conductive disc 18 at substantially the center of the electrically conductive discs 16 and 18. The coaxial cable 30 is terminated at the center of the upper electrically conductive disc 16 thereby providing a center feed at this point. The outer conductive shield of the coaxial cable 30 is additionally grounded to the lower electrically conductive disc 18 via a fourth grounding clip 44.

A service loop 34 is coiled between the upper electrically conductive disc 16 and the lower electrically conductive disc 18 in order to reduce tension by providing slack in the GPS feed cable 32 and to increase its impedance as detected within the cellular communications bandwidth, in order to nullify its effect on the performance of the first antenna 12 when connected electrically in parallel with the shunt legs 20. The impedance of an inductor at a given frequency of operation being given by the product of the vector j, the radian frequency (ω) and the steady state inductance(L). During construction it is important that the service loop 34 be kept away from the center feed 28 of the upper electrically conductive disc 16.

The traversal of the GPS feed cable 32 through the lower electrically conductive disc 18 to the GPS antenna 14 does not create significant interference with the operation of the first antenna 12. This is due to the fact that the GPS feed cable 32 presents a high impedance inductor within the cellular communications bandwidth electrically connected in parallel with the low impedance inductor represented by the shunt legs 20. The GPS feed cable 32 appears as a high impedance inductor at the frequencies of the cellular communications bandwidth due to the composition of the feed cable 32 and the length of the service loop 34 being significantly longer than that of the shunt legs 20. The impedance of an inductor at a given frequency of operation being given by the product of the vector j, the radian frequency (107 ) and the steady state inductance(L). Naturally as the length of the shunt legs 20 increases the corresponding impedance of the shunt legs 20 will also increase and their length must be kept within predetermined limits in order to continue to counteract the effect of the GPS feed cable 32. If the shunt legs 20 were not part of the present invention a different artifice would be required to nullify the effects of the GPS feed cable 32 on the cellular reception and transmission of the first antenna 12.

The close proximity between the GPS antenna 14 and the top of the upper electrically conductive disc 16 of the first antenna 12 permits the upper electrically conductive disc 16 to function as a ground plane for the GPS antenna 14. The ground plane in close proximity with the GPS antenna 14 reduces multipath reflections and ripples in the resulting radiation pattern. A radome 36 is shown in FIGS. 1 and 2 as being cut away to reveal the GPS antenna 14 and the first antenna 12. The radome 36 is typically ultrasonically welded to a bottom cover 50 around the perimeter of the bottom cover 50 in order to create a waterproof seal. Both the radome 36 and the bottom cover 50 are typically constructed from a plastic or resin material for protection from environmental elements. A magnetic mount 52 may also be affixed to the bottom plate 50 to facilitate mounting on any of a variety of metallic surfaces such as the rear deck of an automobile. A standoff 54 is designed to increase the integrity of the first antenna 12 and to maintain a constant distance between the upper electrically conductive disc 16 and the lower electrically conductive disc 18 under normal operating conditions. The GPS feed cable 32 typically comprises an sma connector 56 and the coaxial cable 30 typically comprises a bnc connector 58 for ease of installation.

Figure 7:
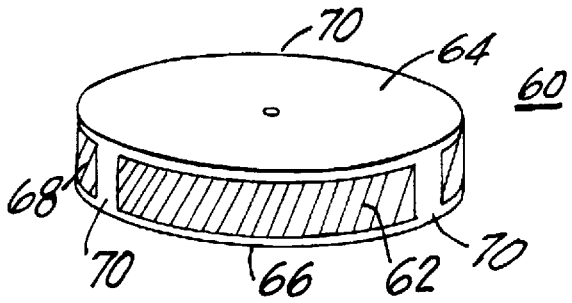
FIG. 7 is a perspective view of a fourth embodiment of an antenna of the present invention.
Figure 10:
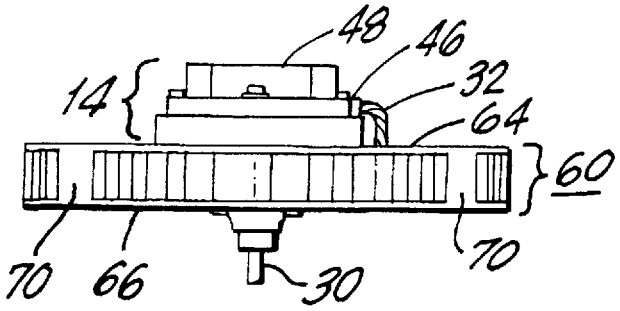
FIG. 10 is a side view of a second embodiment of the composite antenna of the present invention comprising a dielectric filled antenna.

In a second embodiment of the composite antenna of the present invention the GPS antenna 14 may be mounted atop a dielectric filled antenna 60 such as that shown in FIG. 7. It is to be understood that the second antenna is not limited only to a GPS antenna but may, for example, instead comprise a high frequency disk antenna having a frequency response of the order of 2.5 Ghz, a monopole whip antenna or other antennas which may be practically mounted atop the first antenna 12. The complete structure of the composite antenna of the second embodiment is shown in FIG. 10. In this embodiment the dielectric filled antenna 60 comprises a dielectric substrate 62 rather than a volume of free space between upper and lower electrically conductive layers 64 and 66 as described for the first embodiment. The dielectric substrate 62 may be a plastic material such as the composite marketed under the tradename ULTEM. The dielectric filled antenna 60 is of unitary construction, rather than the multipiece assembly shown in FIG. 3 of the first embodiment.

Figure 9A:
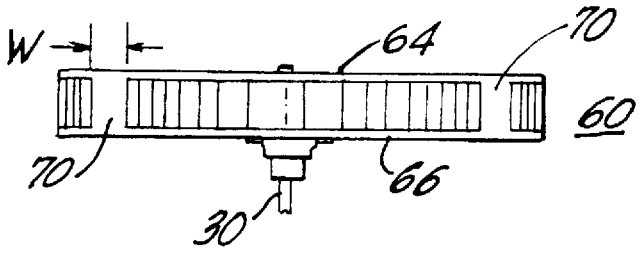
FIGS. 9A and 9B illustrate the antenna of FIG. 7 having a base mounted coaxial cable and a side fed coaxial cable, respectively.

The dielectric substrate 62 is essentially cylindrical in shape and comprises the upper electrically conductive layer 64, the lower electrically conductive layer 66, and a cylindrical side surface 68 as shown in FIG. 7. The upper and lower electrically conductive layers 64 and 66 respectively, are coated with an electrically conductive material such as copper by an electroplating process or other process well known in the art. In addition, three shunts 70 are located on the cylindrical side surface 68 along approximately the perimeter of the dielectric substrate 62 (or other convenient locations) approximately 120 degrees from each other and are formed by an electroplating process well known in the art. The shunts 70 provide electrical connectivity between the upper electrically conductive layer 64 and the lower electrically conductive layer 66. As shown in FIG. 9A, the width W of each shunt 70 is designed large enough to permit a coaxial cable of typical dimensions to be disposed alongside the shunt 70 without disturbing the fields generated by the dielectric filled antenna 60. The width W of shunts 70 may be varied according to the distance between the upper electrically conductive layer 64 and the lower electrically conductive layer 66 in order to impedance match the antenna since the width W is related to the permittivity which is directly related to the impedance of the first antenna 12.

Figure 8:
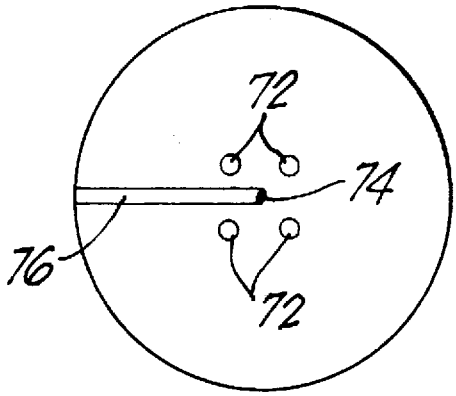
FIG. 8 is a bottom plan view of the antenna of FIG. 7.
Figure 9B:
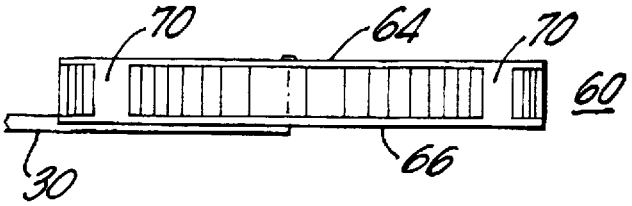

FIG. 8 shows a bottom plan view of the lower electrically conductive layer 66 of the dielectric filled antenna 70. A coaxial cable may be secured to the lower electrically conductive layer 66 by a method well known in the art. Four mounting holes 72 are shown for a coaxial connector having four connection points to be mated with the four mounting holes 72. In this case, the outer conductive shield of the coaxial cable 30 is electrically connected to the connector, and also to the lower electrically conductive layer 66. The inner conductor 30A of the coaxial cable 30 is fed through a bore 74 which is insulated from the lower electrically conductive layer 66, through the dielectric substrate 62, and is soldered or otherwise electrically connected to the upper electrically conductive layer 64. In the alternative, the coaxial cable 30 may be fed directly to the dielectric filled antenna 70 from the side by using a recessed slot 76. The recessed slot 76 serves to position and countersink the coaxial cable 30 permitting a flush mounting of the lower electrically conductive layer 66. The outer conductive shield and inner conductor 30A of the coaxial cable 30 are then connected to the lower and upper electrically conductive layers 66 and 64, respectively, as described above. Thus, the dielectric filled antenna 70 may be adapted for direct center feed or side feed applications according to the application, as shown in FIGS. 9A and 9B respectively.

The mounting technique for the GPS antenna 14 atop the dielectric filled antenna 60 in the second embodiment can be substantially the same as that described above in the first embodiment except that the GPS feed cable 32 would typically be routed around the outside of the dielectric filled antenna 60 rather than between the upper electrically conductive disc 16 and the lower electrically conductive disc 18 since there is no longer free space but rather the solid dielectric therebetween FIGS. 3 and 4 illustrate the first antenna 12 in accordance with a third embodiment of the present invention. As with the first embodiment the third embodiment involves the use of the first antenna 12 designed for application in the cellular band of a generally circular shape which comprises a pair of electrically conductive discs 16 and 18 having a volume of free space between the discs as shown in FIG. 5A and 5B without the addition of the second or GPS antenna 14.

FIGS. 7 and 8 illustrate a fourth embodiment of the present invention. As with the second embodiment the fourth embodiment involves the use of the dielectric filled antenna 60 without the addition of the second or GPS antenna 14.

Although the invention has been shown and described with respect to best mode embodiments thereof, it should be understood by those skilled in the art that the foregoing and various other changes, omissions and additions in the form and detail thereof may be made therein without departing from the spirit and scope of the invention.

We claim:

1. An antenna comprising:

a first electrically conductive disc;

a second electrically conductive disc of substantially the same size as said first electrically conductive disc and aligned substantially in parallel therewith;

first means for application of an electrical signal to and at a substantially geometric center of one of said first and second electrically conductive discs;

a plurality of electrically conductive shunts, each of said shunts being electrically connected at a first end thereof to said first electrically conductive disc to a point on a perimeter of said first electrically conductive disc and at a second end thereof to said second electrically conductive disc to a point on a perimeter of said second electrically conductive disc, whereby said second electrically conductive disc and said first electrically conductive disc are spaced from each other by a volume of free space.

2. The antenna of claim 1 wherein said first means for application of an electrical signal further comprises grounding the other of said first and second electrically conductive discs.

3. The antenna of claim 1 wherein said plurality of electrically conductive shunts comprises three electrically conductive shunts, each of said electrically conductive shunts spaced substantially 120 degrees from each other.

4. The antenna of claim 1 wherein said electrically conductive discs are substantially circular and have a diameter substantially equivalent to three-tenths of one wavelength of an excitation signal.

5. The antenna of claim 1 wherein said electrically conductive discs are spaced approximately six-hundredths of one wavelength of an excitation signal apart.

6. The antenna of claim 1 wherein said first application means comprises a coaxial cable comprising an inner conductor connected to a substantially geometric center of said first electrically conductive disc and an outer conductive shield connected to a substantially geometric center of said second electrically conductive disc.

7. The antenna of claim 1 wherein each of said plurality of electrically conductive shunts are integral with one of said electrically conductive discs and comprise a distal end extending perpendicularly therefrom, and wherein a remaining electrically conductive disc comprises a receiving hole associated with each of said plurality of electrically conductive shunts and adapted to receive therein said distal end of said shunt, and wherein each of said distal ends of said electrically conductive shunts mechanically and electrically interconnect with that portion of said electrically conductive disc surrounding each of said associated receiving holes when said electrically conductive discs are brought into mating relationship therewith whereby structural integrity of said antenna is assured.

8. The antenna of claim 1 in which a width of said electrically conductive shunts is greater than a diameter of a coaxial cable.

9. The antenna of claim 1 in which a width of said electrically conductive shunts is adjusted in order to vary an impedance of said first antenna.

10. An antenna comprising:

a cylindrical substrate of a dielectric material having an upper surface, a lower surface, and a cylindrical side surface disposed therebetween;

a first electrically conductive layer disposed on said upper surface of said substrate;

a second electrically conductive layer disposed on said lower surface of said substrate;

means for application of an electrical signal between and at substantially geometric centers of said first and second electrically conductive layers; and a plurality of electrically conductive shunts electrically connected to said first and second electrically conductive layers, each of said electrically conductive shunts being located on a perimeter of said substrate.

11. The antenna of claim 10 wherein said plurality of electrically conductive shunts comprises three electrically conductive shunts, each of said electrically conductive shunts spaced substantially 120 degrees from each other.

12. The antenna of claim 10 in which said dielectric material comprises a plastic.

13. The antenna of claim 10 in which said first and second electrically conductive layers are formed by electroplating a conductive material on said upper and lower surfaces of said dielectric substrate, respectively, and wherein each of said plurality of electrically conductive shunts comprise a strip of electroplated conductive material disposed on said side surface extending from said first electrically conductive layer to said second electrically conductive layer and electrically interconnecting said first and second electrically conductive layers therewith.

14. The antenna of claim 10 in which a width of said electrically conductive shunts is greater than a diameter of a coaxial cable.

15. The antenna of claim 10 in which a width of said electrically conductive shunts is adjusted in order to vary an impedance of said first antenna.

16. The antenna of claim 10 further comprising a recessed slot extending from said side surface to said substantially geometric center of said second electrically conductive layer, said recessed slot being sufficient to permit a coaxial cable to be disposed therein for supplying an excitation signal thereto.

17. The antenna of claim 10 wherein said application means comprises a coaxial cable comprising an inner conductor connected to a substantially geometric center of said first electrically conductive layer and an outer conductive shield connected to a substantially geometric center of said second electrically conductive layer.

18. A composite antenna comprising:

a first antenna which comprises a first electrically conductive disc;

a second electrically conductive disc of substantially similar size to said first electrically conductive disc and aligned substantially in parallel therewith;

a first means for application of a first electrical signal to and at a substantially geometric center of one of said first and second electrically conductive discs;

a second means for application of a grounding signal to the other of said first and second electrically conductive discs;

a plurality of electrically conductive shunts, each of said shunts being electrically connected at a first end thereof to said first electrically conductive disc and at a second end thereof to said second electrically conductive disc, whereby said second electrically conductive disc and said first electrically conductive disc are spaced from each other by a volume of free space; and a second antenna attached atop said first electrically conductive disc which comprises a second means for application of a second electrical signal to said second antenna which traverses said electrically conductive discs.

19. The composite antenna of claim 18 wherein said second means for application of said second signal further comprises an inductor of substantially greater impedance than that of said electrically conductive shunts being electrically connected substantially in parallel with said electrically conductive shunts, whereby said second means for application of an electrical signal to said second antenna causes no significant interference with and no significant degradation in performance of said first antenna and said second antenna.

20. The composite antenna of claim 18 wherein said first means for application of an electrical signal further comprises grounding the other of said first and second electrically conductive discs.

21. The composite antenna of claim 18 wherein said second antenna comprises a GPS antenna.

22. The composite antenna of claim 18 wherein said plurality of electrically conductive shunts are electrically connected at a first end thereof to a point on a perimeter of said first electrically conductive disc and at a second end thereof to a point on a perimeter of said second electrically conductive disc.

23. The composite antenna of claim 18 wherein said plurality of electrically conductive shunts comprises three electrically conductive shunts, each of said electrically conductive shunts spaced substantially 120 degrees from each other.

24. The composite antenna of claim 18 wherein said electrically conductive discs are substantially circular and have a diameter substantially equivalent to three-tenths of one wavelength of an excitation signal.

25. The composite antenna of claim 18 wherein said electrically conductive discs are spaced approximately six-hundredths of one wavelength of an excitation signal apart.

26. The composite antenna of claim 18 wherein said first means for application of said first electrical signal and said second means for application of said grounding signal comprises a coaxial cable having an inner conductor connected to a substantially geometric center of said first electrically conductive disc and an outer conductive shield connected to a substantially geometric center of said second electrically conductive disc.

27. The composite antenna of claim 18 wherein each of said plurality of electrically conductive shunts are integral with one of said electrically conductive discs and comprise a distal end extending perpendicularly therefrom, and wherein a remaining electrically conductive disc comprises a receiving hole associated with each of said plurality of electrically conductive shunts and adapted to receive therein said distal end of said shunt, and wherein each of said distal ends of said electrically conductive shunts mechanically and electrically interconnect with that portion of said electrically conductive disc surrounding each of said associated receiving holes when said electrically conductive discs are brought into mating relationship therewith whereby structural integrity of said first antenna is assured.

28. The composite antenna of claim 18 in which a width of said electrically conductive shunts is greater than a diameter of a coaxial cable.

29. The composite antenna of claim 18 in which a width of said electrically conductive shunts is adjusted in order to vary an impedance of said first antenna.

30. The composite antenna of claim 18 wherein said second means for application of a second electrical signal comprises a conductive shield which is grounded to said first electrically conductive disc whereby said first electrically conductive disc functions as a ground plane for said second antenna thereby reducing multipath reflections and ripples in a radiation pattern of said second antenna.

31. The composite antenna of claim 18 wherein said second antenna is attached in close proximity with said first electrically conductive disc.

32. A composite antenna comprising:

a first antenna comprising a cylindrical substrate comprising a dielectric material having an upper surface, a lower surface, and a cylindrical side surface disposed therebetween;

a first electrically conductive layer disposed on said upper surface of said cylindrical substrate;

a second electrically conductive layer disposed on said lower surface of said cylindrical substrate;

a first means for application of a first electrical signal between and at substantially geometric centers of said first and second electrically conductive layers;

a plurality of electrically conductive shunts electrically connected to said first and second electrically conductive layers; and a second antenna attached atop said first electrically conductive layer which comprises a second means for application of a second electrical signal to said second antenna which traverses said electrically conductive discs.

33. The antenna of claim 32 wherein said second means for application of said second signal further comprises an inductor of substantially greater impedance than that of said electrically conductive shunts being electrically connected substantially in parallel with said electrically conductive shunts, whereby said second means for application of an electrical signal to said second antenna causes no significant interference with and no significant degradation in performance of said first antenna and said second antenna.

34. The composite antenna of claim 32 wherein said second antenna comprises a monopole whip antenna.

35. The composite antenna of claim 32 wherein said plurality of electrically conductive shunts are electrically connected at a first end thereof to a point on a perimeter of said first electrically conductive layer and at a second end thereof to a point on a perimeter of said second electrically conductive layer.

36. The composite antenna of claim 32 wherein said plurality of electrically conductive shunts comprises three electrically conductive shunts, each of said electrically conductive shunts spaced substantially 120 degrees from each other.

37. The composite antenna of claim 32 in which said dielectric material comprises a plastic.

38. The composite antenna of claim 32 in which said first and second electrically conductive layers are formed by electroplating a conductive material on said upper and lower surfaces of said dielectric substrate, respectively, and wherein each of said electrically conductive shunts comprise a strip of electroplated conductive material disposed on said cylindrical side surface extending from said first electrically conductive layer to said second electrically conductive layer and electrically interconnecting said first and second electrically conductive layers therewith.

39. The composite antenna of claim 32 in which a width of said electrically conductive shunts is greater than a diameter of a coaxial cable.

40. The composite antenna of claim 32 in which a width of said electrically conductive shunts is adjusted in order to vary an impedance of said first antenna.

41. The composite antenna of claim 32 further comprising a recessed slot extending from said cylindrical side surface to said substantially geometric center of said second electrically conductive layer, said recessed slot being sufficient to permit a coaxial cable to be disposed therein.

42. The composite antenna of claim 32 wherein said application means comprises a coaxial cable comprising an inner conductor connected to a substantially geometric center of said first electrically conductive layer and an outer conductive shield connected to a substantially geometric center of said second electrically conductive layer.

43. The composite antenna of claim 32 wherein said second means for application of a second electrical signal comprises a conductive shield which is grounded to said first electrically conductive layer whereby said first electrically conductive layer functions as a ground plane for said second antenna thereby reducing multipath reflections and ripples in a radiation pattern of said second antenna.

44. The composite antenna of claim 32 wherein said second antenna is attached in close proximity with said first electrically conductive layer.

* * * * *